US005186160A

United States Patent [19]

Klein, II

[11] Patent Number: 5,186,160

[45] Date of Patent: Feb. 16, 1993

[54] SOLAR RADON REDUCTION

[76] Inventor: Richard J. Klein, II, 4028 North Ave., Waterloo, Iowa 50702

[21] Appl. No.: 750,987

[22] Filed: Aug. 28, 1991

[51] Int. Cl.[5] ..... F24J 2/04

[52] U.S. Cl. ..... 126/586; 126/631; 126/616; 454/909

[58] Field of Search ..... 454/233, 909; 126/427, 126/428

[56] References Cited

U.S. PATENT DOCUMENTS

| | | | |
|---|---|---|---|
| 3,994,276 | 11/1976 | Pulver | 126/270 |
| 4,069,971 | 1/1978 | Swanson | 126/427 X |
| 4,099,338 | 7/1978 | Mullin et al. | 126/427 X |
| 4,125,222 | 11/1978 | Briscoe | 237/1 A |
| 4,132,356 | 1/1979 | Ramer | 126/428 X |
| 4,287,877 | 9/1981 | Gaines | 126/427 |
| 4,369,765 | 1/1983 | McDaniel | 126/427 |
| 4,493,366 | 1/1985 | Ekman | 165/54 |
| 4,735,130 | 4/1988 | Seppamaki | 98/34.6 |
| 4,773,309 | 9/1988 | Walters | 98/31.6 |
| 4,934,338 | 6/1990 | Hollick et al. | 126/428 |
| 4,969,729 | 11/1990 | Okumura | 126/428 |
| 5,003,865 | 4/1991 | Traudt | 98/1.5 |

OTHER PUBLICATIONS

Radon, the Invisible Threat, What It Is, Where It Is, How to Keep Your House Safe, Michael LaFavore.

U.S. Environmental Protection Agency, *Application of Radon Reduction Methods.*

U.S. Environmental Protection Agency, *Radon Reduction Techniques for Detached Houses.*

*Primary Examiner*—William E. Tapolcai

*Attorney, Agent, or Firm*—Andrus, Sceales, Starke & Sawall

[57] ABSTRACT

A supplementary heat and air supply system for a building includes a solar panel mounted to the exterior of the building, and a solar panel duct extending between the solar panel and the return air manifold of the building's conventional heating system. A fan or blower is positioned within the solar panel duct. The solar panel has a fresh air intake to provide fresh outdoor air to the interior of the solar panel. During daytime hours, when the temperature of air within the solar panel attains a predetermined level, the blower is operated to supply the heated air to the interior of the structure through the solar panel duct, with the heated air being supplied through the return air manifold. When the building's furnace operates, it draws air from the return air manifold, which also acts to draw air from the solar panel through the solar panel duct. The system acts to pressurize the building's interior during operation of the blower, to deter seepage of gases, such as radon, into the building's interior. When the blower is not operating and the furnace is operating, the furnace draws air from the solar panel along with the indoor air. This additionally reduces the amount of pressure drop in the building interior, to again deter seepage of gases into the building.

10 Claims, 1 Drawing Sheet

SOLAR RADON REDUCTION

BACKGROUND AND SUMMARY

This invention relates to a supplementary heating and air supply system, and more particularly to such a system which functions to pressurize or to prevent depressurization of, the interior of a structure and to reduce the concentration of any gases, such as radon, which may seep into the structure.

In heating the interior of a structure, such as a residential or commercial building, it is common to employ a forced air furnace, with duct work extending from the furnace to the various rooms of the building for supplying heated air under pressure during operation of the furnace. Such a system typically includes a return air system for returning air from the rooms to the furnace, which reheats the air and supplies such air to a living area within the building. The return air is supplied to the furnace from the interior of the building.

One problem with a conventional heating system as described is that it draws air for combustion from the interior of the building. Such indoor air typically contains more moisture than outdoor air during the cold weather heating season. In addition, drawing indoor air for combustion reduces the internal air pressure within the building.

In some geographical areas, it has been discovered and well documented that radon gas seeps into the basement of a building through cracks or the like in the foundation, basement walls, floor slab or the waste water discharge system. This problem is compounded when, during operation of the furnace, the pressure within the basement is reduced. Such reduction in pressure results in increased seepage of radon gas into the building's basement.

It is an object of the present invention to provide a supplementary heating and air supply system for use with a conventional heating system, to provide outdoor make-up air to the furnace for combustion during operation of the furnace. It is a further object of the invention to provide a system for reducing seepage of radon gas or the like into the basement of a building.

The invention is employed in connection with a conventional heating system including a furnace and a return air duct extending between the furnace and a return air inlet, which is in communication with the interior of the building. In accordance with the invention, a solar panel is mounted to the exterior of the building, and includes a fresh air intake for receiving air from the exterior of the building, and an outlet for discharging air from the solar panel. A solar panel duct is connected between the solar panel outlet and the return air duct, having a first end in communication with the solar panel outlet and a second end in communication with the return air duct adjacent the return air inlet. A blower is mounted in the solar panel duct. The blower is interconnected with a temperature-sensitive switch associated with the solar panel, such that operation of the blower is initiated when the temperature of air within the solar panel attains a predetermined level. Operation of the blower draws air from the solar panel and supplies such air under pressure through the solar panel duct to the return air duct. When the furnace is not operating, the air supplied by the blower passes through the solar panel duct and the return air inlet, into the interior of the building to provide heat thereto. Upon operation of the furnace, air is supplied to the furnace from the return air inlet. A portion of the return air comes from the room in which the return air inlet is located, and a portion comes from the outlet of the solar panel duct.

With the invention as summarized above, heated air is supplied to the building interior upon operation of the blower. Such supply of heated air not only heats the building interior, but also increases the air pressure in the interior of the building, due to air being supplied to the solar panel from outside the building. This acts to reduce seepage of radon, or other gases, into the building through the basement. During operation of the furnace, a portion of the return air is supplied to the furnace from the solar panel duct. Since the air from the solar panel duct is drawn from outside, it generally contains less moisture than the indoor air and is more efficiently combusted by the furnace along with the fuel.

The invention further contemplates a method of supplying supplementary heat and air, and for reducing the concentration of a gas in the interior of a building, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 shows the system with the furnace off during operation of the solar blower;

FIG. 2 shows the system with the furnace on when the solar blower is not operating; and FIG. 3 shows the system during operation of both the furnace and the solar blower.

DETAILED DESCRIPTION OF THE PREFERRED EMBODIMENT

Figure 1:
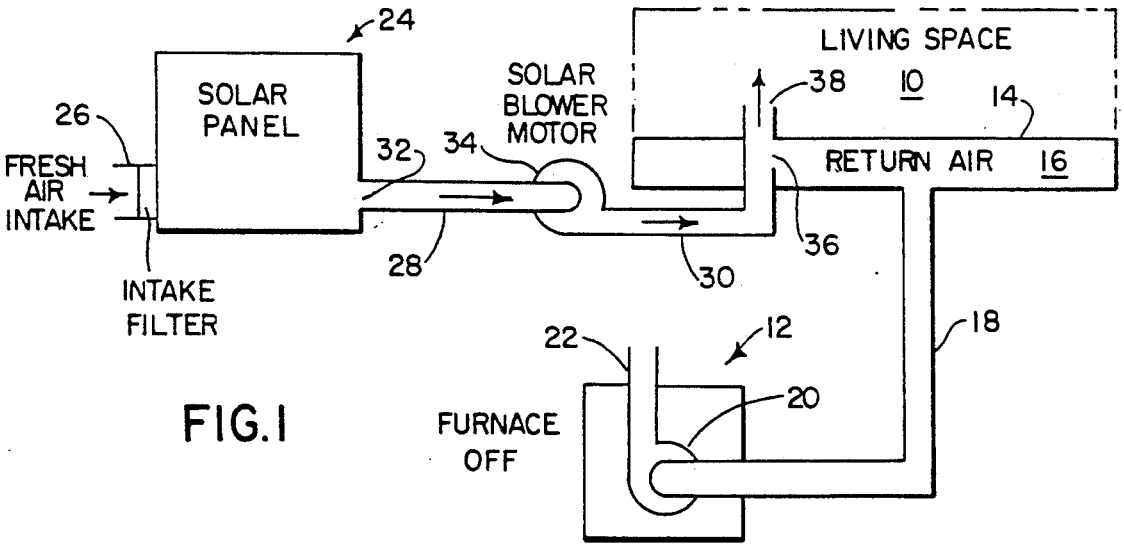
FIGS. 1, 2 and 3 are schematic representations of the supplementary heat and air supply and radon reduction system constructed according to the invention.
Figure 2:
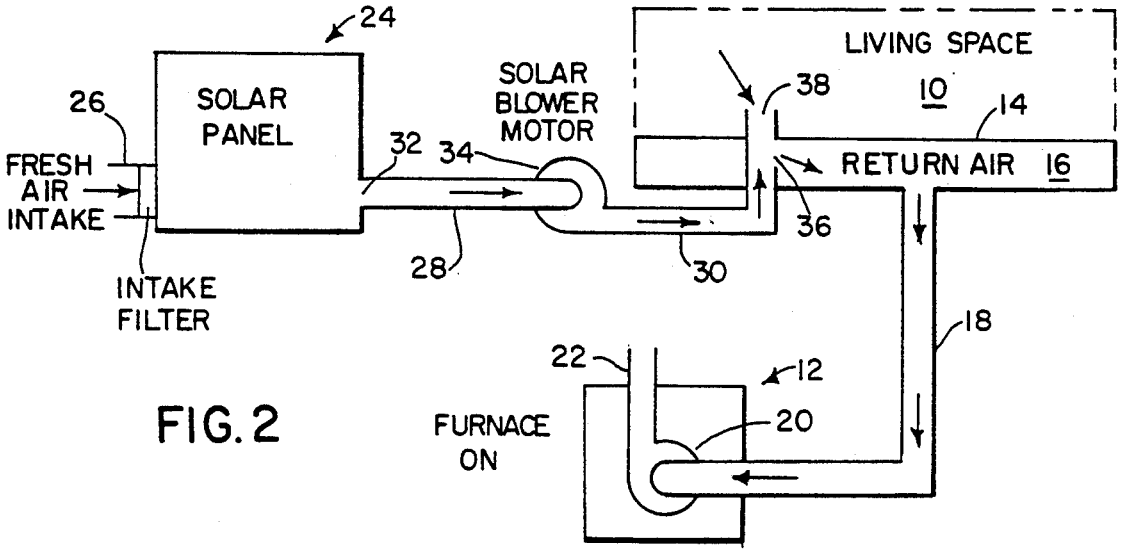
Figure 3:
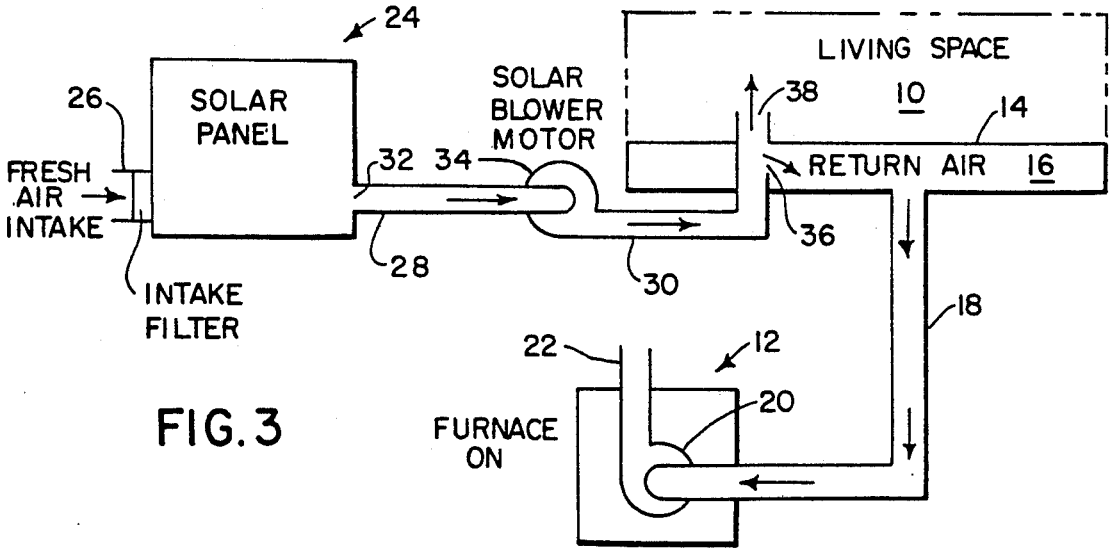

In FIGS. 1–3, an interior room or living space of a building is shown at 10, it being understood that reference character 10 may represent any other space to be heated in the interior of a building or the like. A furnace, shown generally at 12, is located within the building, typically in the building's basement. However, furnace 12 may be in any other satisfactory location within the building.

A return air manifold 14 is provided in living space 10, defining an internal return air cavity 16. Return air manifold 14 may be in any location within living space 10, such as under the floor of the living space. A return air duct 18 extends between return air cavity 16 and an air supply plenum associated with furnace 12.

Furnace 12 is provided with a conventional blower 20 which, during operation of furnace 12, provides heated air to a hot air duct 22. As is known, duct 22 is connected to a series of branch ducts for supplying heated air generated by furnace 12 under pressure to the various rooms of the building.

The above-described components and operation are all well-known.

In accordance with the invention, a solar panel 24 is mounted to the exterior of the building within which living space 10 is located.

Solar panel 24 is of conventional construction, and is typically mounted to the roof of the building with a southerly exposure, to provide a maximum amount of solar energy for heating air within its internal cavity. A fresh air intake passage 26 is associated with solar panel 24, for supplying fresh outside air, from the exterior of the building, to the internal cavity of solar panel 24.

A solar panel duct, consisting of a first portion 28 and a second portion 30, is disposed between solar panel 24 and return air manifold 16. First portion 28 of the solar panel duct defines an inlet 32 in communication with an outlet formed in solar panel 24, such that first portion 28 of the solar panel duct communicates with the internal cavity of solar panel 24. A blower 34 is positioned between first portion 28 and second portion 30 of the solar panel duct. It is understood that blower 34 is schematically illustrated, and alternatively may take the form of a fan placed within the interior passage defined by the solar panel duct.

One end of second portion 30 of the solar panel duct is connected to the outlet of blower 34, so as to receive pressurized air supplied by blower 34 during its operation. The other end of second portion 30 of the solar panel duct is interconnected with return air manifold 14. This end of duct second portion 30 is provided with a first inlet/outlet opening 36 which communicates with the interior of return air manifold 14, and a second inlet/outlet opening 38 which is positioned exteriorly of return air manifold 14 and communicates directly with living space 10.

A temperature-sensitive switch (not shown) is interconnected between blower 34 and the internal cavity of solar panel 24. In this manner, blower 34 operates only when the temperature of air within the internal cavity of solar panel 24 attains a predetermined level, e.g. 110° F.

In operation, the above-described components function as follows.

Fresh air is supplied to the internal cavity of solar panel 24 through intake passage 26, with an intake filter acting to filter air prior to its supply to solar panel 24. When solar panel 24 is exposed to sunlight so as to heat air contained within its internal cavity, and the air temperature attains the predetermined level, blower 34 initiates operation to supply such heated air through first and second portions 28, 30 of the solar panel duct to inlet/outlet opening 38 of duct second portion 30 and into living space 10. This acts to heat living space 10 during daylight hours. In addition, the supply of heated air under pressure from blower 34 maintains living space 10, as well as the building's basement within which furnace 12 is located, under increased pressure, to deter entry of gases, such as radon, into the basement.

A system according to the invention, as shown in FIGS. 1–3, has been installed and it has been discovered that on many cold, sunny days during the winter, blower 34 operates continuously to supply heated air from solar panel 24 to living space 10 sufficient to heat the entire living space, without operation of furnace 12.

When blower 34 shuts off, such as during nighttime hours or cloudy days when the temperature of air within solar panel 24 is not high enough to begin operation of blower 34, operation of furnace 12 to supply heated air to the interior of the building results in air being drawn from return air manifold 16 through return air duct 18. The resulting generation of negative air pressure within return air manifold 16 draws cold outside air from solar panel 24 through the solar panel duct first and second portions 28, 30 and inlet/outlet opening 36 of duct second portion 30. The cold outdoor air is mixed with the interior air drawn into return air manifold 16, and is supplied through return air duct 18. The mixing of cold outdoor air with the warmer indoor air results in more efficient heating and combustion of the air-fuel mixture upon operation of furnace 12, due mainly to the lowered moisture content provided by the cold outdoor air through solar panel 24.

During this mode of operation, the amount of air drawn from the interior of the building for combustion by furnace 12 is reduced by the amount of make-up air drawn from solar panel 24. This decreases the amount by which interior air pressure is reduced during operation of furnace 12, again reducing the amount of gas, such as radon, which otherwise would be drawn into the building's basement upon operation of furnace 12.

During simultaneous operation of blower 34 and furnace 12, as illustrated in FIG. 3, heated air supplied by blower 34 is simultaneously discharged into living space 10 through inlet/outlet opening 38 of duct second portion 30, and to return air manifold 16 through inlet/-outlet opening 36 of duct second portion 30. In this manner, some outside air is mixed with the interior air supplied through return air duct to furnace 12, while some heated outdoor air is supplied to living space 10. This acts both to decrease the pressure loss in the building interior during operation of furnace 12, and also to provide some heated air into living space 10.

It should be appreciated that the discharge of second portion 30 of the solar panel duct should feed directly into return air manifold 16 for the most efficient supply of heated air into living space 10, to increase efficiency of the system.

The foregoing description has referred primarily to a gas or oil fired heating system. It is understood, however, that the system of the invention may also be advantageously used with an electric heating system or any other type of heating system.

The system of the invention can be installed for an extremely low cost, in that very few components are needed, and the necessary components can be easily installed. The only moving parts in the system are provided by blower 34, which is a very low maintenance piece of equipment.

The system provides no net increase in operating costs, even though on many days blower 34 may operate continuously during the day. This is mainly because blower 34 may take the form of a relatively small fan, requiring low amounts of power to operate. It has been found that, on average, the temperature of the building's interior can be maintained at a higher level during daytime hours, and that on average furnace 12 will not begin operation until the later evening hours.

In addition, the home in which the system of the invention was installed had a radon concentration of 8.8 pci/1, recorded over a five-day period prior to installation of the system. After installation of the system, a radon concentration of 2.5 pci/1 was recorded for a six-day period, resulting in a net 72% reduction in radon level.

As can be appreciated, the invention performs two purposes very well, namely utilizing solar energy to conserve fossil fuel, and acting to reduce levels of radon in the interior of a building.

Various alternatives and embodiments are contemplated as being within the scope of the following claims particularly pointing out and distinctly claiming the subject matter regarded as the invention.

I claim:

1. A supplementary heating and air supply system for use with a conventional heating system including a furnace and a return air duct extending between the furnace and a return air inlet in communication with the interior of a structure, comprising:

a solar panel mounted to the exterior of the structure and including a fresh air intake for receiving air from the exterior of the structure, and an outlet for discharging air from the solar panel;

a solar panel duct having a first end in communication with the solar panel outlet and a second end in communication both directly with the interior of the structure and with the return duct adjacent to the return air inlet; and a blower for drawing air from the solar panel and supplying such air through the solar panel duct either directly to the interior of the structure or to the return duct;

whereby operation of the blower supplies heated air from the solar panel through the solar panel duct either directly to the interior of the structure or to the return duct for discharge through the return air inlet into the interior of the structure, and whereby operation of the furnace draws air from the solar panel duct through the return duct.

2. The system of claim 1, wherein the solar panel duct has its second end in communication with a return air cavity provided at the return air inlet, and wherein the return air duct extends between the return air cavity and the furnace.

3. The system of claim 2, wherein the second end of the solar panel duct includes a first inlet/outlet opening located within the return air cavity and a second inlet/-outlet opening located exteriorly of the return air cavity and within the interior of the structure.

4. The system of claim 1, wherein the blower is located within the solar panel duct between the solar panel and the return air inlet.

5. A method of supplying supplementary heat and air for a conventional heating system including a furnace and a return air duct extending between the furnace and a return air inlet in communication with the interior of a structure, comprising the steps of:

mounting a solar panel to the exterior of the structure, the solar panel having a fresh air intake for receiving air from the exterior of the structure, and further having an outlet for discharging air therefrom;

placing the solar panel outlet in communication either directly with the interior of the structure or with the return air duct adjacent the return air inlet;

supplying heated air under, pressure from the solar panel outlet to the interior of the structure when the temperature of air within the solar panel reaches a predetermined level; or drawing air from the solar panel through the return air duct upon operation of the furnace.

6. The method of claim 5, wherein the step of placing the solar panel outlet in communication with the return air duct adjacent to the return air inlet comprises connecting a solar panel duct having a first end in communication with the solar panel outlet and a second end in communication with the return air inlet.

7. The method of claim 6, wherein the return air inlet communicates through a return air cavity with the interior of the structure, and wherein the second end of the solar panel duct is provided with a first inlet/outlet opening and a second inlet/outlet opening, and is connected such that the first inlet/outlet opening is in communication with the return air cavity and the second inlet/outlet opening is located exteriorly of the return air cavity and communicates directly with the interior of the structure.

8. The method of claim 6, wherein the step of supplying heated air under pressure from the solar panel outlet comprises placing a blower within the solar panel duct and operating the blower to supply heated air to the second end of the solar panel duct.

9. The method of claim 8, wherein the step of operating the blower is carried out when the temperature of the air within the solar panel reaches a predetermined level.

10. A method of reducing the concentration of a gas, such as radon, in the interior of a structure having a heating system including a furnace and a return air duct extending between the furnace and a return air inlet in communication with the interior of the structure, comprising the steps of:

mounting a solar panel to the exterior of the structure, the solar panel having a first air intake for receiving air from the exterior of the structure, and further having an outlet for discharging air therefrom;

placing the solar panel outlet in communication either directly with the interior of the structure or with the return air duct adjacent to the return air inlet;

supplying heated air under pressure from the solar panel outlet to the interior of the structure when the temperature of air within the solar panel reaches a predetermined level, to thereby provide heated air to the interior of the structure and to pressurize the interior of the structure; or drawing air from the solar panel through the return air duct upon operation of the furnace, to decrease the amount of air drawn by the furnace from the interior of the structure.

* * * * *